US007396049B2

(12) United States Patent
Nelson et al.

(10) Patent No.: US 7,396,049 B2
(45) Date of Patent: Jul. 8, 2008

(54) FLEXIBLE SHEET HAVING AT LEAST ONE REGION OF ELECTROLUMINESCENCE

(75) Inventors: Veronica A. Nelson, Albany, OR (US); David M Kwasny, Corvallis, OR (US); Marjan S. Amesbury, Albany, OR (US); Don King, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 479 days.

(21) Appl. No.: 10/971,638

(22) Filed: Oct. 20, 2004

(65) Prior Publication Data

US 2005/0082820 A1 Apr. 21, 2005

Related U.S. Application Data

(63) Continuation of application No. 10/268,417, filed on Oct. 9, 2002, now Pat. No. 6,886,864.

(51) Int. Cl.
*B42D 109/00* (2006.01)

(52) U.S. Cl. ..... 283/83; 281/51; 446/485; 40/452

(58) Field of Classification Search ..... 281/15.1, 281/21.1, 51; 446/485; 40/442, 444, 447, 40/448, 452, 463, 465, 544; 283/61, 62, 283/63.1, 83

See application file for complete search history.

(56) References Cited

U.S. PATENT DOCUMENTS

| | | | | | |
|---|---|---|---|---|---|
| 2,543,670 | A * | 2/1951 | Regensburg | ..... | 40/367 |
| 3,869,818 | A * | 3/1975 | Marcellus | ..... | 40/471 |
| 4,195,431 | A * | 4/1980 | Neufeld | ..... | 40/544 |
| 4,209,824 | A * | 6/1980 | Kaufman | ..... | 362/98 |
| 4,286,399 | A * | 9/1981 | Funahashi et al. | ..... | 40/124.02 |
| 4,299,041 | A * | 11/1981 | Wilson | ..... | 40/124.02 |
| 4,703,573 | A * | 11/1987 | Montgomery et al. | ..... | 40/455 |
| 5,167,508 | A * | 12/1992 | Mc Taggart | ..... | 434/317 |
| 5,301,982 | A * | 4/1994 | Brotz | ..... | 283/83 |
| 5,413,486 | A * | 5/1995 | Burrows et al. | ..... | 434/317 |
| 5,484,292 | A * | 1/1996 | McTaggart | ..... | 434/317 |
| 5,597,183 | A * | 1/1997 | Johnson | ..... | 283/83 |
| 5,609,488 | A * | 3/1997 | McTaggart | ..... | 434/317 |
| 6,021,306 | A * | 2/2000 | McTaggart | ..... | 434/317 |
| 6,124,851 | A * | 9/2000 | Jacobson | ..... | 345/206 |
| 6,205,690 | B1 * | 3/2001 | Heropoulos et al. | ..... | 40/442 |
| 6,252,564 | B1 * | 6/2001 | Albert et al. | ..... | 345/1.3 |
| 6,274,985 | B1 * | 8/2001 | Haynes | ..... | 315/169.3 |
| 6,639,578 | B1 * | 10/2003 | Comiskey et al. | ..... | 345/107 |
| 6,680,725 | B1 * | 1/2004 | Jacobson | ..... | 345/107 |
| 2001/0018809 | A1 * | 9/2001 | Heropoulos et al. | ..... | 40/544 |
| 2007/0096456 | A1 * | 5/2007 | Silverman | ..... | 281/51 |

* cited by examiner

*Primary Examiner*—David P. Bryant
*Assistant Examiner*—Eric A Gates

(57) ABSTRACT

A flexible sheet which includes a substrate having at least one visually discernable surface and at least one electroluminescent lamp assembly positioned proximate to the surface and controlled by a suitable power source as well as means for isolating at least one electroluminescent lamp assembly from deleterious interaction with environment external to the flexible sheet. The flexible sheet can be employed in various applications including bound books, functional cards, locational orientation devices as well as in mechanisms for selectively indicating ingress or egress from architectural structures and other safety indicators. At least one component of the flexible sheet with the electroluminescent lamp assembly can be produced by drop ejection.

10 Claims, 5 Drawing Sheets

FLEXIBLE SHEET HAVING AT LEAST ONE REGION OF ELECTROLUMINESCENCE

This application is a continuation of U.S. application Ser. No. 10/268,417, filed Oct. 9, 2002, now U.S. Pat. No. 6,886, 864 the specification of which is incorporated herein by reference.

The present invention is directed to a flexible sheet having at least one region of electroluminescence and methods of making the same. The present invention is also directed to a device composed of at least one flexible sheet having at least one electro-luminescent lamp assembly associated therewith.

BACKGROUND OF THE INVENTION

The need for flexible, visually enhanced devices particularly flexible visually enhanced print media arises in a variety of situations. In print media such as books and the like, it can be advantageous to enhance characteristics or other indicia such as illustrations which are typically carried on a page as conventional print with additional devices which are aesthetically pleasing and/or intellectually interactive with the viewer or reader. For instance, various book devices have been proposed which integrate audio playback devices, glow in the dark ink, or backlit pages. A central battery generally powers such devices.

Visually enhanced devices have been enthusiastically received. However the range of application has been somewhat limited. Constraints regarding power supply and the types of power sources which can be used have limited the applications for such devices. Power output constraints can also be a factor in limiting the useful life of the associated device. Limitations regarding the size, precision and/or accuracy of the placement of characters or indicia on the page or substrate surface have also limited the utility of associated devices. Finally, most interactive sheets or pages necessarily have been thick and rigid elements in order to protect and maintain the visual enhancement and any electronic circuitry and leads associated with the page itself.

While various types of interactive and/or visually enhanced media have been proposed, electroluminescent lamp assemblies in such devices show certain advantages. Electroluminescent lamp assemblies typically provide an appealing glowing characteristic and can be configured to have desirable operational power requirements.

Heretofore, the application of interactive or electronically augmented visually enhanced media employing electroluminescent lamp assemblies has been limited to applications in which the rigidity of the sheet can be strictly maintained. This may be feasible in certain situations such as in children's board books and the like but it becomes problematic where greater degrees of bending or flexibility are required. It can also become problematic in situations which require the use of individual sheets such as with function cards, novelty cards and the like. Additionally, it has been difficult to use visual enhancement devices such as electroluminescent lamps in situations where the associated substrate is to be applied to uneven and/or flexible underlying surfaces. Heretofore, electroluminescent lamp assemblies required the associated use of stiffening devices to insure sufficient rigidity to insure proper function of the electroluminescent lamp. Thus, the use of devices employing electroluminescent lamps assemblies as all or a part of the interactive and/or visual enhancement has been limited in areas such as in safety applications, locational orientation devices and the like.

SUMMARY OF THE INVENTION

The present invention is a flexible sheet which includes a substrate having at least one visually discernable surface, at least one electroluminescent lamp assembly positioned proximate to the surface, at least one electroconductive trace located in the substrate connecting the electroluminescent lamp assembly with a power source and a protection layer associated with the electroluminescent lamp assembly. The protection layer isolates at least one electroluminescent lamp assembly from deleterious interaction with environment external the flexible sheet.

The flexible sheet may be employed as various applications; for example bound books, function cards, locational orientation devices as well as safety indicators.

DETAILED DESCRIPTION OF THE EMBODIMENTS

The present invention is a flexible sheet which is capable of use as an interactive and/or electronically augmented, visually enhanced device. The flexible sheet is suitable for application in areas which include, but are not limited to, books, locational orientation devices such as maps and charts as well as safety devices, novelty items such as collector's cards, and as decoration or ornamentation on objects such as fabric and the like.

The present invention is predicated, at least in part, on the discovery that electroluminescent lamp assemblies can be built or otherwise integrated into flexible substrate materials such as paper stock, flexible polymeric film and the like in a manner which maintains at least a degree of the original flexibility of the substrate material without unduly compromising electroluminescent lamp function. As employed herein, the term "flexible" is taken to mean capable of concave or convex deviation from planar; particularly around a line in the sheet such as longitudinal or latitudinal axis defined in the flexible sheet. The concave or convex deviation may be temporary or more sustained. The term "flexible sheet" of the present invention may also include suitable fold lines about which the sheet may be folded. The flexible sheet of the present invention may be manipulated in the folded or convex/concave manners so indicated without unduly comprising the function or control of associated electroluminescent lamp assembly or assemblies.

Figure 1:
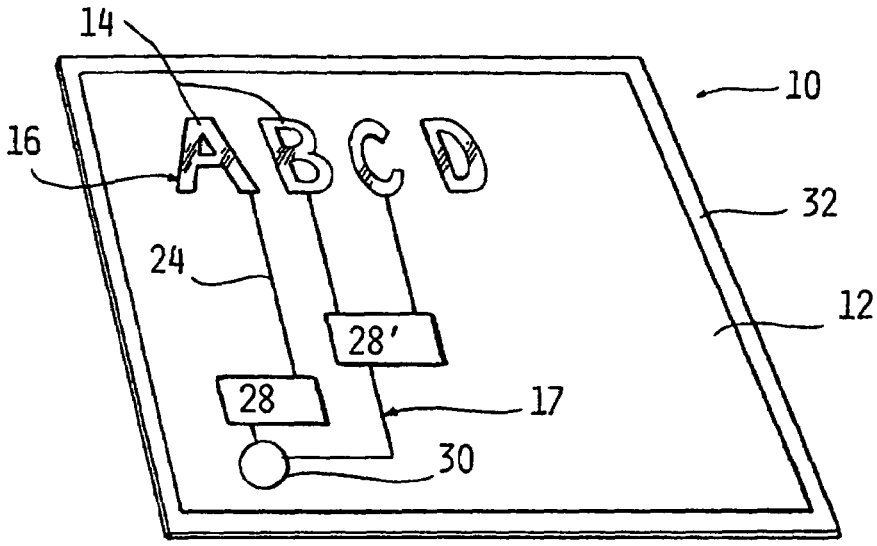
FIG. 1 is a perspective drawing of a flexible sheet according to an embodiment of the present invention.
Figure 5:
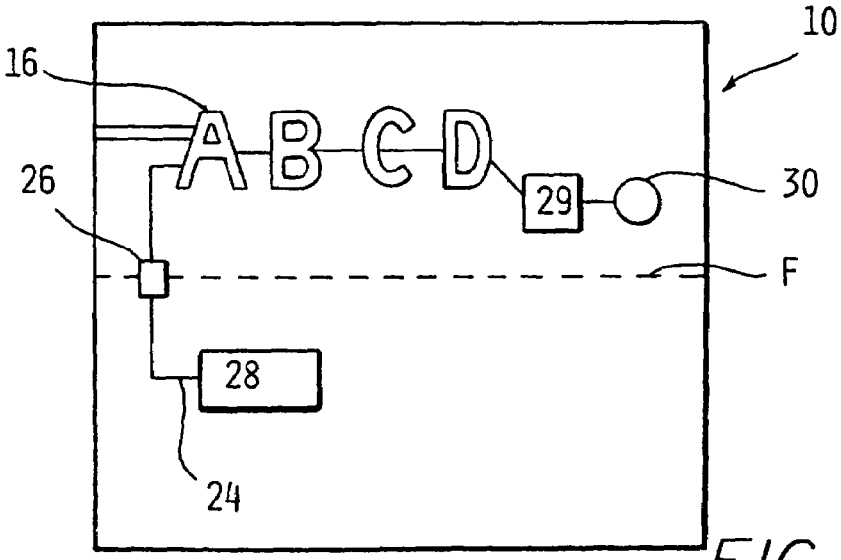
FIG. 5 is a flexible sheet according to an embodiment of the present invention showing a schematic of a power source and controller.
Figure 6:
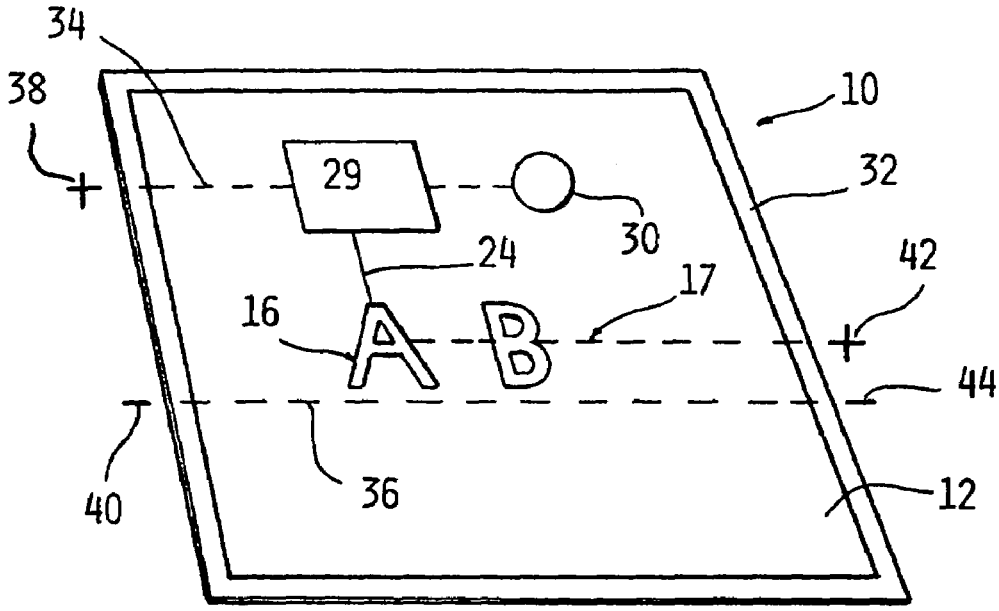
FIG. 6 is a perspective view of a flexible sheet according to an embodiment of the present invention having externally communicating leads.

The present invention as depicted in FIGS. 1, 5 and 6 is a flexible sheet 10 which includes a substrate 12. The substrate 12 has at least one surface which is visually discernable and has at least one light transmissive region 14 located on the substrate, preferably, at a location proximate to the visually discernable surface.

The substrate 12 will have sufficient thickness to accommodate various electronic augmentation devices which will be discussed in greater detail subsequently. The substrate 12 may have any length and width appropriate for the desired end use. It is also within the purview of this invention that the substrate 12 may be configured as an elongated length or roll of material which can be employed as such or can be configured to be separated into smaller units, preferably at specific separation regions located at intervals along the length of the flexible sheet.

The substrate material comprises any suitable natural or synthetically derived material or combination thereof. Suitable substrate materials preferably include at least one of polymeric films, non-woven substrates, fibrous sheet material such as paper and the like. The substrate 12 may comprise a single layer of substrate material or may comprise a plurality of layers in overlying orientation to one another. Multiple layers may be laminated or affixed to one another in any suitable manner.

Preferably, the material of choice employed in substrate 12 is one which is suitable for the use to which the device employing the flexible sheet 10 of the present invention is to be put. Thus, if the flexible sheet 10 is to carry printed characters, the substrate 12 will have at least at least one visually discernable surface which is suitable for receiving and maintaining characters or other indicia imprinted thereon.

In the preferred embodiment, the visually discernable surface of substrate 12 is exteriorly oriented so as to provide appropriate visibility. The visually discernable surface has at least one light transmissive region 14 positioned thereon. Each light transmissive region 14 may be configured as desired or required to convey information pertinent and relevant to the purpose of the flexible sheet 10. For example, the light transmissive region 14 can be configured as alphanumeric shapes, geometric shapes or various indicia, characters, illustrations or the like. Each light transmissive region 14 may have any size and configuration desired or required. Light transmissive regions 14 are positioned on the substrate in a configuration consistent with the information to be conveyed by the flexible sheet 10. The location of each light transmissive region 14 may also be influenced by considerations of bendability of the substrate 12 to accommodate at least a limited degree of rolling or contour and/or moderate folding along predetermined fold lines in the manner described subsequently.

As depicted in FIGS. 1, 5 and 6, the light transmissive region 14 may be configured as a series of characters. The light transmissive region 14 can be of any size suitable to the end purpose of the flexible sheet 10. The light transmissive region 14 may be configured to convey visual information and/or information in spectral ranges outside visual discernment where necessary. It is also within the purview of this invention that the light transmissive region may provide a suitable surface on which other information is printed or inscribed. Such information may include suitable non-light transmissive indicia, characters, alphanumeric shapes and the like. It is to be understood that a given light transmissive region 14 may encompass one or more characters or indicia or a portion of a character or other indicia as desired or required.

The light transmissive region 14 may be composed of any material which is capable of transmitting light in the visible or non-visible range or of being capable of being rendered light transmissive when integrated into an electroluminescent lamp assembly. Preferably light transmissive regions 14 are integrated into the substrate 12 in a suitably uniform manner such that a visually harmonious surface is presented to the viewer. The light transmissive regions 14 are positioned so as to accept, maintain, and/or integrate with printing or illustration on the surface thereof.

Figure 2:
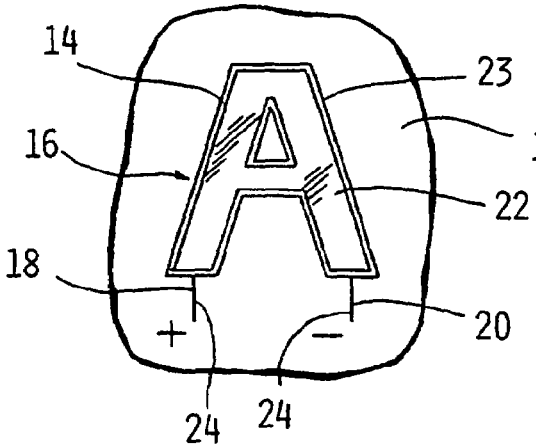
FIG. 2 is a detail drawing of an electroluminescent lamp assembly and associated indicia of the flexible sheet according to an embodiment of the present invention.

It is within the purview of the present invention that the light transmissive region 14 be employed alone or in conjunction with overlaid media 22 such as ink 22 imparted thereon. The overlaid media 22 as shown in FIG. 2 may be non-light transmissive; thereby creating a backlit effect. The overlaid media 22 may also have luminescent or other light transmitting characteristics such as phosphorescent ink or the like. The overlaid media 22 may be composed of multiple regions of various materials as desired or required to create the desired aesthetic effect.

The flexible sheet 10 of the present invention includes at least one electroluminescent lamp assembly 16 which is positioned relative to the substrate to provide visual detectability to the light transmissive region 14. Preferably, the electroluminescent lamp assembly 16 is positioned proximate to the visually discernable surface of the substrate 12. The electroluminescent lamp assembly 16 employed in the flexible sheet 10 of the present invention may have any suitable configuration for providing electroluminescence to the light transmissive region 14 and/or any characters, illustrations or other indicia associated therewith. While the foregoing discussion has been directed to association of character, illustration or other indicia with a single electroluminescent lamp assembly 16, it is within the purview of this invention to employ a plurality of electroluminescent lamp assemblies 16 as desired or required to illuminate a given character, illustration or indicia. Where a given character, illustration or indicia has a plurality of electroluminescent lamp assemblies associated therewith, the present invention contemplates capacity to enhance and/or alter the manner in which the character, illustration or indicia is perceived by changes in the sequence, pattern or number of electroluminescent lamps 16 which are illuminated. It is also possible to associate specific electroluminescent lamp assemblies 16 with distinct sections of the light transmissive region or inks associated therewith. Thus, it is possible to selectively illuminate a character or indicia in different colors upon receipt of appropriate commands and/or different intervals. Thus, the flexible sheet 10 of the present invention may be enabled with animation capabilities.

Generally speaking, the electroluminescent lamp assembly 16 employed in the present invention will comprise at least a first electrode, electroluminescent material and at least one second electrode. The electroluminescent material employed will compose at least a portion of the light transmissive region 14 positioned proximate to the surface of substrate 12.

The flexible sheet 10 of the present invention also includes at least one connection member 17 establishing electrical communication between the at least one electroluminescent lamp assembly 16 and a suitable power source. The connecting member 17 can include at least one conductive trace 24 which communicates with an appropriate power source such as on-board power source 28 shown in FIGS. 1 and 5 or an external power source (not shown) as would be employed with the flexible sheet as depicted in FIG. 6. Generally, suitable electroluminescent lamp assemblies 16 are a capacitor structure with an organic or inorganic phosphor employed as at least a part of the light transmissive region with the phosphor sandwiched between the two electrodes. Application of voltage across the electrodes generates a changing electric field within the phosphor particles causing them to emit light. Typically voltage is applied as AC voltage. For most electroluminescent lamps, an inverter can be used in the power source. An inverter is DC-AC converter which generates a desired voltage at a desired frequency; typically 60-115V AC at 50-1000 Hz. It is contemplated that the phosphor may be either inorganic such as zinc sulfide compounds or organic such as any of a variety of OLED materials as well as combinations of organic and inorganic materials as suitable.

The electroluminescent lamp assemblies employed in the flexible sheet 10 of the present invention may be solid electroluminescent panels positioned at predetermined desired locations in the substrate. Where solid electroluminescent lamp assemblies are employed, it is contemplated that the substrate 12 will, be composed of a plurality of discrete layers in overlying relationship with one another, thereby providing a rear layer, a cover layer and at least one thin electroluminescent lamp assembly positioned therebetween. Access regions 23 such as apertures or access door features are configured in at least one of the cover and rear layers of substrate 12 allowing light to emit from these areas. The electroluminescent panel employed is generally sufficiently thin to maintain a flexible sheet of relatively constant thickness.

It is also contemplated that the electroluminescent lamp assembly may be associated with a substrate 12 by selectively imparting discrete defined regions of specific color and/or conductive media in desired patterns onto or into the substrate 12. As desired or required, the resulting flexible sheet may have at least one lighted region which may be multi-colored as desired or required.

The substrate 12 will be one which can effectively receive the component parts of the electroluminescent lamp assembly 16. In one deposition scenario, the substrate 12 is composed of material suitable to receive appropriate materials deposited thereon. At least one of the materials deposited thereon will have light transmittance, electroconductive characteristics or the like which render the material suitable to be employed in electroluminescent lamp assembly 16. In this scenario, it is contemplated that at least a portion of the substrate 12 is composed of an electroconductive film 50 having at least some light transmissive characteristics. Electroconductive film 50 may be of any suitable type and thickness. Materials such as polyester films sputtered with conductive materials such as indium tin oxide (ITO) or coated with a suitable conducting polymer can be successfully employed. Alternately, suitable printed conducting translucent ink can be imparted on to a clear base substrate by a selective deposition method such as drop ejection. Once the light transmissive layer 50 is established, a suitable electroluminescent material 52 such as phosphors and the like, dielectric 54 and second electrode 56 may be imparted into position in a manner such that the electroluminescent material 52 is positioned between first electrode/light transmissive layer 50 and second electrode 56.

Figure 3:
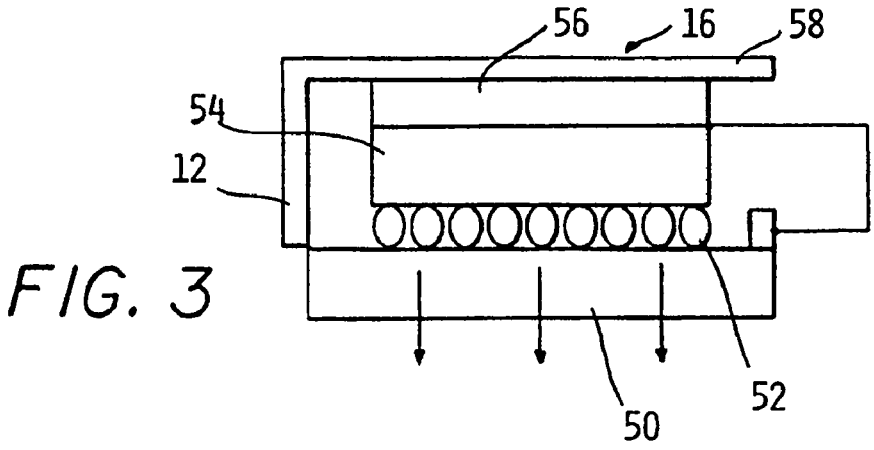
FIG. 3 is a cross-section of one type of electroluminescent lamp assembly of FIG. 2.

The second electrode 56 may be positioned in any suitable location relative to first electrode 50. As depicted in FIG. 3, the second electrode 56 is disposed rearwardly of first electrode 50 with suitable dielectric 54 and phosphor 52 positioned between second electrode 56, phosphor 52 and dielectric 54 can be imparted by any suitable manner such as screen printing or ink jetting. In order to protect the electroluminescent lamp assembly from adverse interaction with moisture and the like, the electroluminescent lamp assembly can also include an overlying layer of clear encapsulant 58. Various UV cure inks as well as solvent inks can be used as an encapsulant 58 to provide electrical insulation. The encapsulant 58 can also serve as means for isolating the associated electroluminescent lamp assembly 16 from deleterious interaction with environment external to the flexible sheet 10; for instance from moisture, humidity and the like. It is also within the purview of the present invention to build the electroluminescent lamp assembly 16 on substrate 12 by imparting second electrode material directly on the substrate by a suitable method such as by drop ejection techniques.

Figure 4:
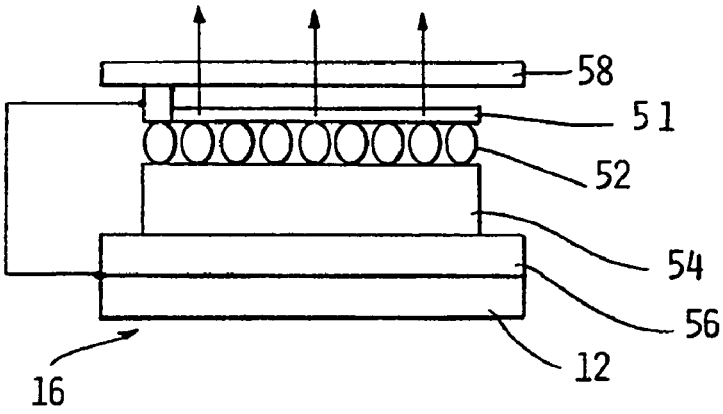
FIG. 4 is a cross-section of an alternate type of electroluminescent lamp assembly of FIG. 2.

In the build sequence, as depicted in FIG. 4, the second electrode material may be positioned on the substrate 12 in any desired predetermined pattern. Suitable configurations will maintain the capacitative relationship of the various elements. As shown in FIG. 4, a suitable dielectric 54 is imparted in overlying relationship to the second electrode 56 such that the electroluminescent material 52 such as phosphor is disposed in electronically isolated relationship to the second electrode 56; preferably by the interpositioning of a suitable dielectric 54. As shown in FIG. 4, dielectric 54 is in overlying relationship to second electrode 56, with electroluminescent material 52 in overlying relationship to dielectric 54. However, it is to be understood that other orientations are possible which maintain the isolation of the electroluminescent material such as phosphor from electrode. As further depicted in FIG. 4, a conductive translucent electrode layer 51 can be positioned in overlying relationship with the electroluminescent layer 52 such as the phosphor layer. The resulting assembly can be overlaid by a 1:0 suitable light transmissive encapsulant 58.

The at least one conductive trace 24 can be composed of any suitable organic or inorganic material imparted in the substrate 12 which is capable of providing organized electronic communication between power source 28 (or other source, not shown) and the electroluminescent lamp assembly 16. In the preferred embodiment the at least one conductive trace 24 is integrated into the substrate 12 in a manner which permits and/or facilitates at least some limited flexing and movement of substrate 12 from planar without unduly compromising electronic function.

The conductive trace 24 may be imparted onto the substrate by any suitable manner; one example of which is jet deposition. In the embodiments shown in FIGS. 1 and 5, conductive trace 24 is depicted as a visible line. However, it is to be understood that conductive trace 24 may be inherently invisible or may be embedded in a multi-layer opaque substrate and, thus not be readily discernable to the viewer. The number of traces 24 and the routing of the trace(s) is determined by the particular design of the given flexible sheet 10.

The power source 28 may be any suitable device for providing sufficient energy to illuminate the associated one electroluminescent lamp assembly or assemblies 16. Examples include, but are not limited to, thin film batteries, photovoltaic cells and the like. In embodiments of the flexible sheet 10 of the present invention as shown in FIGS. 1 and 5, the flexible sheet includes at least one on-board power source 28. In the embodiment shown in FIG. 6, the power source or sources (not shown) are remote from the flexible sheet 10. Such remote power source(s) can include any suitable assemblies which can deliver the desired power to the electroluminescent lamp assembly or assemblies 16 present on the substrate 12. It is to be understood that the remote power sources are also considered to include suitable conduits for conveying power from the remote source to the substrate 12 and associated electroluminescent lamp assembly 16. Examples of suitable remote power supply conduits include but are not limited to devices such as power cords.

Where an on-board power source 28 such as in FIGS. 1 and 5 is employed, it is contemplated that it will be located in the substrate 12 in a manner which permits appropriate flexing of the flexible sheet 10 as desired or required. The power source 28 may be composed of one or more self-contained power storage or power generating assemblies. Such devices will be positioned in the substrate and oriented relative to the at least one electroluminescent lamp assembly 16 in an essentially coplanar relationship when the substrate 12 is in an unflexed state. Examples of suitable power sources include, but are not limited to, photovoltaic cells, thin film batteries and the like.

The terms "flexing" and "bending" are used herein to describe orientation of the flexible sheet 10 relative to itself in a manner which deviates from planer. "Flexing" is defined as the curvilinear orientation of the sheet 10 in a longitudinal, latitudinal or diagonal fashion as would occur when material is spiral wrapped or is required to conform to an associated non-planar underlying substrate. "Bending" is used herein to define an action wherein the sheet is folded along a predetermined fold line such as fold line F in FIG. 5 to permit folding of the material in either a visual surface to visual surface orientation or an opposed orientation.

While the fold line F may be a sharp angular crease, it is preferred that fold line F be a more arcuate curve defined in the flexible sheet by any suitable method to permit the desired accordion-like or surface-to-surface orientation. The degree of angularity permitted is that which can occur without undue impairment of the function of the associated electroluminescent lamp assembly 16.

The region surrounding fold line F may include suitable reinforcement to accommodate such folding. Additionally, the region may include suitable visual and physical adaptations to permit or encourage folding along the predetermined fold line F. These can include, but are not limited to, appropriate detents or regions of corrugation defined in one or more layers of the substrate 12.

Suitable reinforcements also include adaptations 26 in leads 24 where they cross fold line F. The adaptations 26 can include reinforcement couplings in lead 24 across the fold region as required. Fold lines F are preferably positioned relative to electroluminescent lamp assemblies 16 to minimize direct impact on electroluminescent lamp assembly or assemblies 16.

Without being bound to any theory, it is believed that the positioning of electroconductive materials employed in electroluminescent lamp assembly elements and any associated electroconductive traces associated therewith by a suitable drop ejection or screen printing contributes to the ultimate flexibility of the electroluminescent lamp assembly 16, lead 24 and/or overall device. In the case of drop ejection, it is believed that this is due, at least in part, to the phenomenon whereby discrete volumes of the desired material are positioned in discrete contiguous relationship with one another during the printing process to form a continuous imprintment of multiple discrete regions. It is believed that the discrete continuous units of material when positioned on the substrate, retain a degree of physical flexibility relative to one another which facilitates at least a limited degree of flex not found in material imprinted by other methods.

As indicated in FIGS. 1 and 5, the power source 28 can be positioned at any suitable location in the substrate 12. Preferably, the power source 28 is located proximate to and essentially planer with the electroluminescent lamp assembly 16.

By "proximate" it is meant that the power source is located within the bounds of the material which comprises the substrate 12. The term "essentially planer" is employed to indicate that the material is positioned in the major plane defined by substrate 12, preferably in a manner which provides an essentially even contour or flat surface to the visually visible surface of the substrate 12. Various types of on-board power sources 28 are contemplated. The preferred on-board power source 28 is one which provides sufficient energy to illuminate the associated lamp electroluminescent lamp assembly or assemblies 16 for an appropriate use interval. Various photovoltaic cells and/or battery mechanisms can be used. The preferred power source can be a thin film battery or cell which can be positioned at any suitable location in the substrate relative to the associated at least one electroluminescent lamp assembly 16. While the power source 28 is configured as a rectangle in FIGS. 1 and 5, it is to be understood that the power source 28 can be positioned and configured in any manner which will be compatible to the flexible sheet and will provide appropriate power output. The battery or cell may be configured to be single use, rechargeable, or any suitable configuration which is consistent with the desired use of the flexible sheet 10. Thus, where required, the on-board power source 28 can also include suitable means (not shown) for replacement or recharge as desired or required.

Additionally, power source 28 can include appropriate circuitry or mechanisms for conserving power expenditure. These can include, but are not limited to, devices and programs which will control or curtail delivery of electric current from the power source 28 to the electroluminescent lamp assembly 16 when the flexible sheet is not in use. Such devices, circuits and mechanisms include, but are not limited to various on/off switches as well as devices which receive and interpret external environmental input to control the associated switch. For example, such input and control may be accomplished with the use of at least one sensor 30 and associated switches. It is contemplated that devices such as sensor 30 would be capable of detecting at least one input condition which can be interpreted and converted into a control signal actionable on the on-board power source 28 and suitable switches associated therewith.

Conditions in the environment external to the flexible sheet 10 which could trigger activation or deactivation of power source 28 and associated electroluminescent lamp assembly 16 can include, for example, at least one of movement, proximity, temperature change, light level, and the like. Where sensor 30 is employed, it is contemplated that the substrate 12 will include appropriate logic and control devices such as logic device 29 associated with the sensor 30 to interpret the inputted data and to translate it into an appropriate control command. Thus, if a light sensitive sensor is employed, the operation of the electroluminescent lamp assembly 16 could be keyed to change in ambient light sensed by the sensor 30, with deactivation of the electroluminescent lamp assembly 16 occurring as the sensor or sensors record a decrease in the ambient environmental light and activation occurring with an increase. Similarly, the logic and control device may be one which interprets touch pad data or other stimuli. Thus, while the embodiment in FIGS. 1, 5 and 6 shows one sensor 30, it is contemplated a plurality of sensors may be suitably positioned in appropriate locations in the substrate 12 relative to electroluminescent lamp assemblies 16 to control the activation and/or deactivation of the associated electroluminescent lamp assembly 16 in relation to predetermined external environmental stimuli.

As indicated previously, the flexible sheet 10 includes suitable protection layer which isolate the electroluminescent lamp assembly 16 and/or associated components from deleterious interaction with environment external to the flexible sheet 10. The protection layer can include the encapsulation layer 58 discussed previously. The protection layer may also include a sheet or layer integrated into the substrate 12, typically in overlying relationship with the electroluminescent lamp assembly 16. The protection layer may cover all or part of the substrate 12. It is also contemplated that the isolation sheet may be integrated into the substrate 12 as a layer in a multi-layer construction. The protection layer may also be configured as an encapsulating sleeve 32 which encases and overlays the entire substrate 12 to prevent such deleterious interaction. Preferably the protection layer or sleeve 32 is essentially transparent and of sufficient thickness to prevent or minimize such deleterious interaction without impairing perception of the visually discernable surface. The protection layer or encapsulation sleeve 32 may be made of any suitable material. Preferably the material employed will be one which resists water and may include suitable contours (not shown) to facilitate bending such as regions of corrugation and the like which correspond to fold line F.

In situations where the substrate 12 is composed of polymeric material or other substances which are water impervious, the substrate 12 itself may function, at least partially, as an encapsulating media and serve to isolate sensitive components from adverse interaction with external environmental conditions. In such situations, encapsulation sleeve 32 for isolating the electroluminescent lamp assembly may be minimized or eliminated.

The term "deleterious interaction with external environment" is employed herein to refer to exposure to various factors which could compromise the function of at least one electroluminescent lamp assembly 16, one or more of the leads 24 or the power source 28. As such deleterious interactions include, but are not limited to, permeation by moisture in the form of either humidity or liquid as well as contamination by dirt, organic oils, sweat and the like as would typically occur when the flexible sheet 10 is employed in normal usage such as in reading, handling and the like. While the protection layer has been shown as an encapsulating sleeve 32 in FIG. 1 or a sheet which overlays the substrate 12, it is also contemplated that the isolation means could be more limited and proximate to the elements which are considered moisture sensitive such as the electroluminescent lamp assembly 16, leads 24, power source 28, etc. Where the protection layer is more limited, it is contemplated that suitable protective or isolating material can be integrated directly into the substrate to isolate the desired element.

It is also contemplated that the flexible sheet 10 may be configured with suitable conduit(s) or trace(s) for communicating with at least one power source (not shown) which is located outside the bounds of the substrate 12. As indicated in FIG. 6, electroluminescent lamp assembly 16 can be powered through appropriately associated externally communicating leads 34, 36 which have appropriate communication points 38, 40, 42, 44 adapted to provide appropriate electrical and/or electronic communication to a source external to the substrate 12. As depicted in FIG. 6, the electronic lead 34 can be configured to communicate with at least one associated electroluminescent lamp assembly 16. It is contemplated that the electroluminescent lamp assembly 16 can provide a closed circuit and/or leads can be configured to traverse substrate 12 to communicate with additional devices external to the flexible sheet 10 such as through communication at leads 42, 44. It is also considered within the purview of this invention, that at least one electroluminescent lamp assembly 16 on a flexible sheet 10 can be in communication with other individual flexible sheets 10 or suitable intermediary members to provide a continuous communication through a plurality of sheets 10 to an external power source or a power source contained on only one of the sheets 10. The additional individual flexible sheets 10 may have suitable electroluminescent lamp assemblies positioned as desired or required. "Suitable intermediary members" is taken to include sheets which lack electroluminescent lamp assemblies but are configured to transmit appropriate current and/or electronic information.

It is also contemplated that the flexible sheet 10 can be provided with appropriate communication points 38, 40, 42, 44 to provide electronic or electrical communication of various data which will permit the interactive communication between of flexible sheets 10. The actual connective communication between points 38, 40, 42, 44 for either power conveyance or interactive communication can be either permanent or can be a removably accomplished. Where communication with an external power source is contemplated, the communication between communication points such as those at 38, 40 may be permanent.

Where the electronic communication is established for interactive function, it is contemplated that it will involve the conveyance of various logic sequences, inputs, outputs or impulses. In such situations, it is contemplated that the communication between communication points 38, 40, 42, 44 and associated leads of various flexible sheets 10 can be of a more temporary nature. While communication points 38, 40, 42, 44 are depicted as extending to two opposed lateral edges of the substrate 12, it is to be understood that the number of leads and their position may be determined by the end use to which the flexible sheet is to be put. The communication points 38, 40, 42, 44 and associated electronic traces such as traces 34, 36 can be integrated into the substrate 12 in any suitable fashion.

The flexible sheet 10 of the present invention can also utilize logic circuits created in the substrate. Suitable logic circuits are capable of maintaining appropriate intelligence for controlling the activation and/or deactivation of one or more electroluminescent lamp assemblies 16 according to a governing protocol. As desired or required, the logic and control device 29 can interact with appropriate ON/OFF circuits, as well as receiving any pertinent input from devices such as sensor 30. The logic/intelligence defined and/or contained in the logic and control device 29 can include appropriate algorithms and the like for illuminating the indicia and associated with the electroluminescent lamp assembly 16 in a given order as desired or required by the use to which the flexible sheet 10 is put. Thus, the logic and control device 29 can be part of a circuit established with suitable electronic connection between the various electroluminescent lamp assemblies 16. Suitable electronic communication is, preferably accomplished by at least one electronic trace 24 which is in communication between the electroluminescent lamp assembly 16 and the logic circuit 29. The logic circuit may include or be composed of suitable logic and control devices which include, but are not limited to electronic chips and the like. The logic and control device 29 such as electronic chip can be configured to store and retrieve preprogrammed logic to function to control illumination of electroluminescent lamp assembly or assemblies in an interactive manner based on inputs from the sensor or sensors 30.

Figure 7:
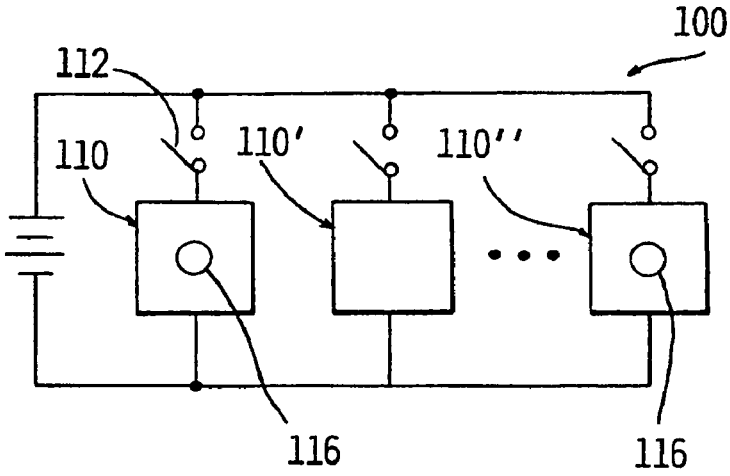
FIG. 7 is a circuit diagram of a switching mechanism for multiple flexible sheets according to an embodiment having a source of power external to the sheet.
Figure 8:
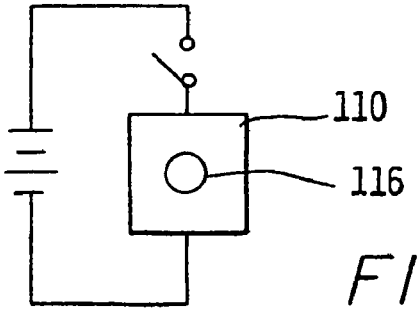
FIG. 8 is a circuit diagram for a flexible sheet according to an embodiment in which each electroluminescent lamp assembly has its own power source associated proximate thereto.

A basic circuit for switching the electroluminescent lamp assembly 16 ON or OFF is depicted in FIGS. 7 and 8. In FIG. 7, a simplified schematic for a suitable switching mechanism for use with a device having a plurality of flexible sheets is proposed. In the proposed circuit 100, a plurality of lamps with respective sheets 110, 110', 110" are placed in parallel with means for establishing appropriate electronic contact within the circuit such as by switch mechanism 112. As depicted in FIG. 7, it is considered within the purview of this invention that not every flexible sheet include a functioning electroluminescent lamp assembly 116 as depicted in sheet 110'. The functional sheets 110, 110" are equipped with an appropriate sensor which is electronically connected to an appropriate ON/OFF circuit 112 to permit the illumination or activation of the electroluminescent device 116 upon receipt of appropriate input. The sensor can be any type of photosensitive, touch or other sensor that will generate a signal to close the switch and activate the electroluminescent lamp assembly 116.

As depicted in FIG. 8, the electroluminescent lamp assembly 116 may have its own power source associated directly therewith. The power source can be a thin film battery, solar cell, watch battery or other power source as desired or required. The device can be equipped with an appropriate sensor which will permit activation upon receipt of appropriate trigger.

Figure 9:
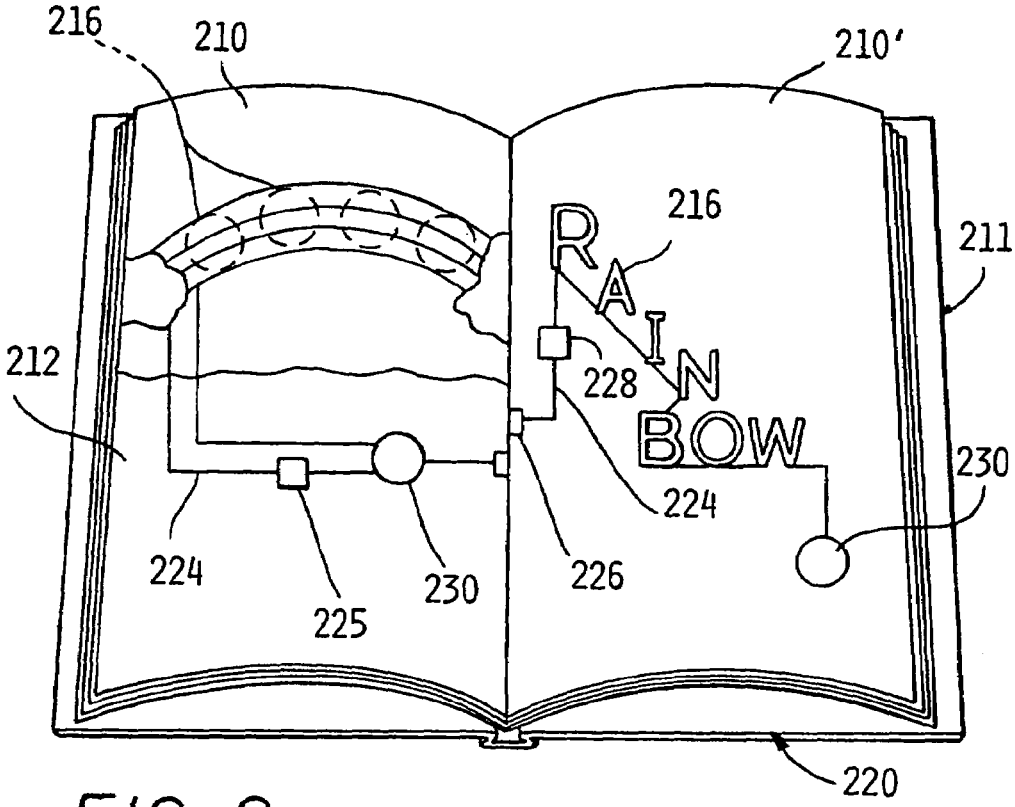
FIG. 9 is a perspective view of a book device employing at least one flexible sheet according to an embodiment of the present invention.

The flexible sheet 10 of the present invention can be advantageously employed in a variety of different end use applications. As illustrated in FIG. 9, flexible sheets 210, 210' are integrated in codex fashion into book 211. Pages 210, 210' can have at least one visually discernable surface with suitable characters and/or indicia printed thereon. As depicted, each flexible sheet 210, 210' composes an individual page in the book 211. Where desired or required, the flexible sheets 210, 210' may also be configured so that opposed surfaces can be usually discernable with suitable characters and/or indicia printed thereon. The flexible sheets which make up the pages of the book 211 may be secured into a suitable binding 220 as desired or required. Appropriate pages can include at least one electroluminescent lamp assembly 216 on substrate 212. The electroluminescent lamp assemblies 216 can be controlled by appropriate control mechanisms or sensors such as depicted at 230. The electroluminescent lamp assemblies 216 can communicate with a suitable power source through appropriate electroconductive traces 224 which can be connected to appropriate leads 226. It is contemplated that individual sheets 210, 210' may have a suitable power source 228 integrated therein as indicated in FIG. 9. In such configurations, it is contemplated that the power source 228 may provide power for multiple electroluminescent lamp assemblies on multiple pages. Thus, it is within the purview of this invention to incorporate the power source in one or more of the flexible sheets 210, 210' and provide appropriate electronic and electrical communication between pages if desired in the region of the respective pages proximate to the spine. It is also contemplated that a suitable power source or sources (not shown) as well as various other auxiliary apparatus and devices may be positioned in the binding 220 in certain applications.

As desired or required, the electroluminescent lamp assemblies 216 can provide either visible light or back lighting effects for the visually discernable text or other indicia or characters contained in the pages of the book 211. Exemplary of illustration is the rainbow depicted on sheet 210. The rainbow has a plurality of electroluminescent lamp assemblies 216 positioned in underlying relationship to the illustration. A suitable controller 225 controls the illumination of electroluminescent lamp assemblies 26. The illumination of the electroluminescent lamp assemblies 216 can occur in a preprogrammed sequence contained in and transmitted from controller 225. The sequence can be initiated by any suitable event such as receipt of initiation input from sensor 230. For example, the electroluminescent lamp assemblies 216 on page 210 could illuminate sequentially from left to right to animate the rainbow.

The flexible sheet illustrated at 210' shown in FIG. 9 has a plurality of characters, each having an associated electroluminescent lamp assembly 216. Sensor 230 can be employed to illuminate the associated electroluminescent lamp assemblies at will or in a desired preprogrammed manner. The page 210' may have suitable control mechanisms as desired or required to execute appropriate illumination.

Sensor devices can also be incorporated into each page 210, 210' to control illumination of the electroluminescent lamp assemblies based upon the opening or closing of the book and associated page 210, 210'. This can be used to illuminate electroluminescent lamp assemblies 216 essentially at will and to conserve power reserves. It is contemplated that power conservation devices may be incorporated into sensor 230 or may be contained in a device which exists separate from the sensor 230. It is also contemplated that a suitable power conservation device may be employed in flexible sheets 210 without being connected to additional input and illumination control sensors to provide simple on/off control.

It can be readily appreciated that the complexity of illumination patterns is a function of the desired content and purpose for the flexible sheet 210 as bound into the book device 211. Examples of the use of flexible sheets augmented by electroluminescent lamp assemblies include the use of such pages as teaching assistance tools. In such applications that appropriate printed text, either as alphanumeric text and/or illustrations, can be augmented by electroluminescent lamp assemblies which are controlled by appropriate logic and control devices to provide on-demand or controlled illumination to assist in communicating information such as phonics rules, math facts, grammar and usage, scientific phenomenon and the like. These tools could be particularly advantageous in providing adaptive learning tools to individuals with various learning challenges such as dyslexia, non-verbal learning disorders and the like. The flexible sheets such as sheets 210, 210' employed in the book 211 may be imprinted with a suitable combination of conventional print text and electroluminescent lamp assemblies to convey the desired information based on preprogrammed logic and/or externally inputted commands. The illumination of electroluminescent lamp assemblies may be in any pattern or sequence indicated by the governing controllers. Thus it is contemplated that the information conveyed by a given page or flexible sheet 210 can be staged or tiered based upon programming contained on one or more pages or in various regions of the book 211. The information conveyed can be customized to the learning style and/or information needs of a particular user. The conveyance of information can be adaptively altered based upon preprogrammed options or other criteria.

The flexible sheets 210, 210' can employ a suitable substrate 212 which may permit additional writing or printing on the surface thereof. Thus, it is contemplated that the book 211 in question may be either a permanent text or a consumable, single use workbook. The flexible sheets 210, 210' can provide a look and feel to the user which is similar to that of sheets typically employed in books and texts not augmented with electroluminescent lamp assemblies. It is contemplated that such volumes can provide adaptive learning and reading opportunities in a manner which is less noticeable in a classroom environment or the like.

Figure 10:
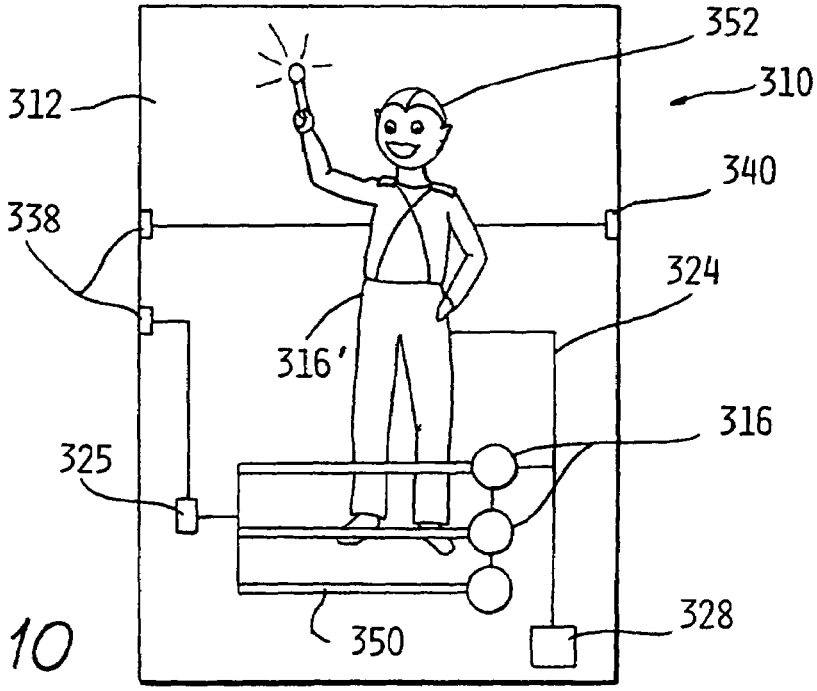
FIG. 10 is a perspective view of a functional card composed of a flexible sheet according to an embodiment of the present invention.

While the flexible sheet of the present invention has been illustrated as a portion of a larger bound volume, it is also within the contemplation of this invention that the flexible sheet of the present invention can be employed as a self-contained individual unit. The device in FIG. 10 is a flexible sheet configured as a function card 310. As used herein, the term "function card" is defined as an essentially self-contained card having printing or other indicia located thereon. Such function cards 310 may be individual or may exist as part of a larger collection or deck. Examples of function cards include novelty trading cards, game cards, event tickets, event programs and the like.

The flexible function card 310 will have at least one electroluminescent lamp assembly. As depicted in FIG. 10, the function card 310 has a plurality of electroluminescent lamp assemblies 316, 316' positioned on a suitable substrate 312. For example, the electroluminescent lamp assemblies depicted in FIG. 10 include text as illustrated at 316 and a character 316'. The electroluminescent lamp assemblies 316, 316' are in electronic communication with a suitable power source such as on-board battery 328 through electronic traces 324. The function card can optionally include at least one appropriate sensor 325 which can receive appropriate inputs and convert them into suitable controlling signals. Flexible sheet 310 also includes suitable indicia such as print indicia 350 and illustration 352 which can be illuminated as desired or governed by suitable controlling mechanisms. As depicted in FIG. 10, the device has an on-board power source 328, examples of which can include but are not limited to thin film batteries, photovoltaic cells and the like.

The function card 310 can be self-contained or can have appropriate leads 338, 340 which permit communication with an appropriately configured external member such as one found on similarly configured function cards. Where such leads 338, 340 are employed, it is contemplated that the leads will be capable of permitting interruptible electronic communication between similarly configured novelty cards or between a card and a suitable game board or the like. In this manner, quantities of information can be communicated between cards or between cards and a suitable support surface such as a game board when appropriate contact is established. Thus, a plurality of flexible cards 310 can be suitably configured to provide an interactive game in which various electroluminescent lamp assemblies 316, 316' on various cards are illuminated in preprogrammed sequence given their proximity to other similarly configured cards or position on a support surface. In such instances, the cards can be employed as a game for pleasure or as an adaptive learning or educational tool depending upon the logic and governing rules desired or required.

Where flexible function card 310 is configured as an adaptive learning tool, it is envisioned that one or more flexible sheets configured as flexible function cards can be employed. In such situations, the adaptive learning tool will include at least one logic storage unit located on the substrate in communication with the electroluminescent lamp assembly (not shown). The logic storage unit contains at least one program for controlling interactive illumination of electroluminescent lamp assemblies. The adaptive learning device also includes at least one user interface connected to the logic storage unit for receiving input from the user.

Figure 11:
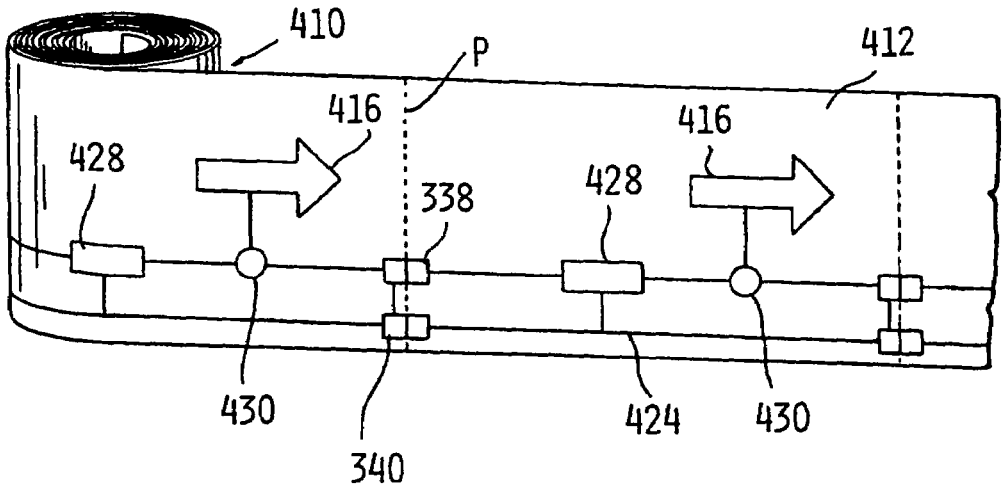
FIG. 11 is a perspective view of a flexible sheet according to an embodiment of the present invention integrated in to a spiral wrap roll with suitable regions for separation defined therein.

The flexible sheet of the present invention can be configured as a safety strip which can be employed in various uses. A spiral wrapped configuration of the flexible sheet configured as a safety strip 410 is depicted at FIG. 11, with schematic views of a flat-version elongated flexible sheet depicted at FIGS. 13 and 14. The safety strip 410 is an elongated strip of a suitable substrate 412 having at least one electroluminescent lamp assembly 416 placed at spaced intervals thereon. The electroluminescent lamp assembly 416 may be powered by a suitable external power source (not shown) which is in communication with the electroluminescent lamp assembly 416 by a suitable conductive trace 424. Alternately, the safety strip 410 may be powered by a suitable on-board power source as will be described subsequently.

Figure 13:
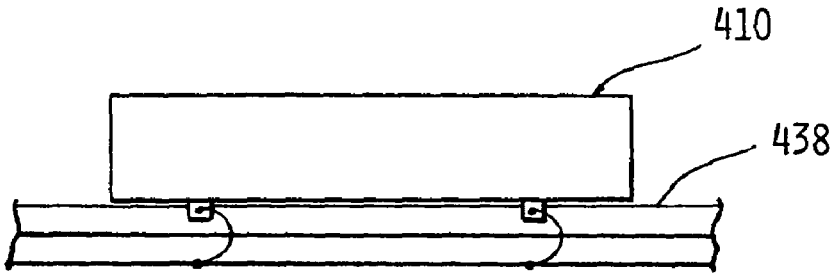
FIG. 13 is a schematic view of a flat-version elongated flexible sheet according to an embodiment in contact with an underlying power transfer device.
Figure 14:
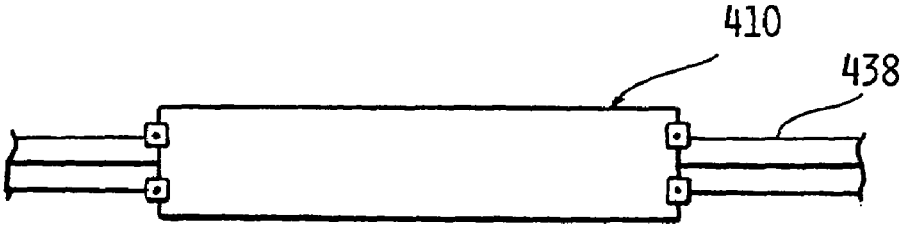
FIG. 14 is a schematic view of the flat version elongated flexible sheet according to an embodiment of FIG. 13 depicting an alternate connection modality.

The safety strip 410 is, preferably, an elongate member which will have appropriate length and width as mandated by the substrate on which it is to be affixed. The safety strip 410 may be stored as a plurality of units in overlying relationship to one another. Alternately, the safety strip 410 may be stored in a spiral wrapped configuration as depicted in FIG. 11. Where the safety strip 410 is adapted to be rolled in a spiral wrapped configuration, it can be fed from the wrap into contact with a suitable underlying substrate. The underlying substrate may provide a suitable surface. Where desired, the underlying substrate may include a suitable flat power supply device (not shown). The safety strip 410 can be equipped with appropriate mounting members 438 to fasten or affix the safety strip 410 to an underlying surface as desired or required. Examples of such mounting members include adhesive strips and the like. Where appropriate, it is contemplated that the mounting member can also include electroconductive mechanisms for providing power throughout the strip as desired or required electrically in parallel (or series) fashion, such as a parallel linear assay. As depicted in FIGS. 13 and 14, the safety strip 410 is present as an elongated planar member which is adapted to adhere to a suitable substrate by means of an mounting member 438. In either embodiment, it is contemplated that the mounting member 438 may be either integrally attached to the underlying surface of the safety strip 410, or may be a separate unit to which the safety strip 410, is applied. The mounting member 438 may be configured with suitable current or data carrying conduits 440 which communicate with the strip as by leads 442. The flexible sheet 410 may also be configured to include a power source 428 in substrate 412. Examples of suitable power sources include, but are not limited to, thin film batteries, photovoltaic cells and the like. The power source 428 can be rechargeable or single use as desired or required. It is also contemplated that various individual sheets 412 configured with power sources 428 may be employed in contiguous relation with additional flexible sheets 410 which lack an associated on-board power source to supply power to electroluminescent lamp assemblies in both types of respective flexible sheets.

As depicted in FIG. 11, the safety strip 410 may include predetermined regions of separation or perforation P. The predetermined perforation regions P include appropriate leads 338, 340 for establishing communication between separated portions of the safety strip 410 where desired or required. In use, the safety strip 410 can be placed on a suitable underlying substrate; examples of which include walls, floors, articles of clothing or the like. Upon receipt of appropriate input signals from sensors 430 or alternately, from an external command conveyed from an external source, the electroluminescent lamp assemblies 416 embedded in the safety strip 410 can be illuminated to show an appropriate indicia or instruction. Examples of uses for such safety strips include, but are not limited to, emergency exit directional aids in the case of power failure or other events triggering an emergency exit and the like. It is also contemplated that the safety strip can be configured to be affixed to a substrate such as an article of clothing to provide illumination when desired or required. The article of clothing can, then, be rendered visible under conditions of low light or poor visibility such as jogging or riding, particularly at twilight or nighttime.

Figure 12:
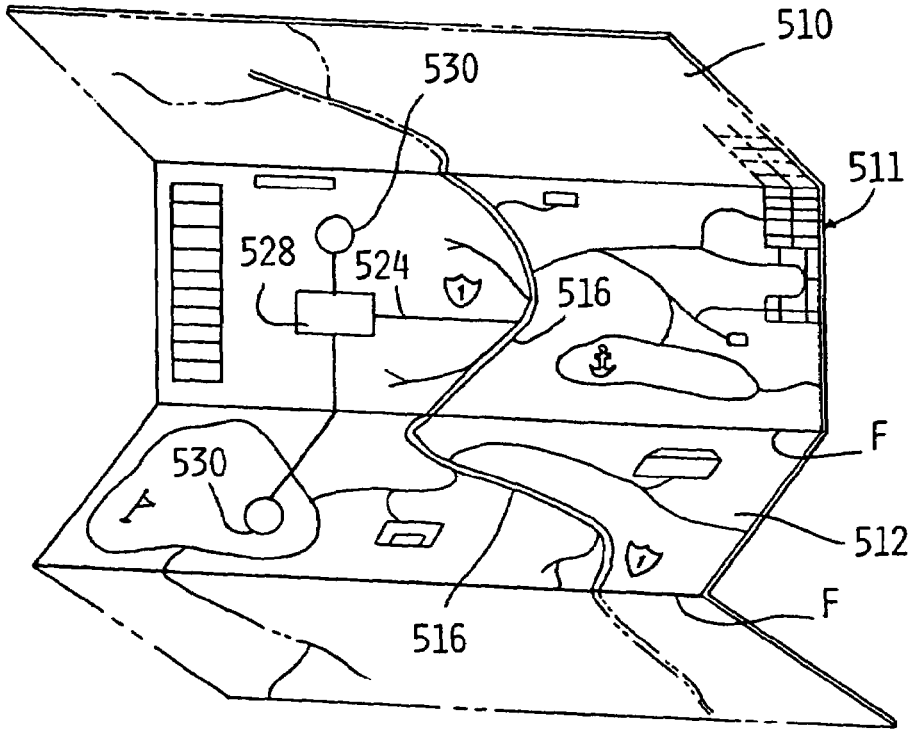
FIG. 12 is a perspective view of a locational orientation device composed of a flexible sheet according to an embodiment of the present invention.

The flexible sheet can also be employed in locational orientation devices such as the device 511 shown in FIG. 12. The term locational orientational device as used herein includes various charts, diagrams and maps for establishing positional orientation of an object or person. As depicted in FIG. 12, the locational orientation device 511 includes a map or other directional indicia at least a portion of which can be selectively illuminated by at least one appropriate electroluminescent lamp assembly 516. Such indicia can show roads, topographical information, or interior directional information such as locations and points of interest in a shopping mall, amusement park or the like.

The electroluminescent lamp assemblies 516 can be powered by a suitable on-board power source 528. The power source 528 can be rechargeable or single use as desired or required. The locational orientation device 511 also includes suitable sensors 530. These sensors can include appropriate logic to control the illumination of the various indicia according to external commands or information already programmed in a suitable memory device contained in or associated with the sensor 530 or other suitable device associated with the device 511. Additionally, it is contemplated that the locational device 530 may include devices to receive wireless information (not shown) which would trigger the illumination of various indicia based upon external input from sources such as geo-synchronous satellites, ground-based transmitters or the like.

The locational orientation device 511 is a folded sheet 510 having at least one fold region F. It is contemplated that the locational orientation device may include a plurality of such fold regions to facilitate either accordian-like, surface-to-surface folding or other folding patterns. Such fold regions F permit the easy and compact storage of the locational orientational device 510 as well as permitting the device to be opened and positioned as desired to aid the individual user. As indicated previously, it is contemplated that the device would have suitable reinforcements and connections across the fold F.

The electroluminescent lamp assembly 516 can be integrated into the substrate 512 by any suitable manner which will permit appropriate flexing and bending of the resulting flexible sheet 510. It is contemplated that electroluminescent lamp assemblies 516 of suitable size and shape can be integrated into the substrate so as to adapt to regions of extreme folding and flexing. As depicted in FIG. 12, electroluminescent lamp assembly 516 is configured to depict a road traversing the regional map. It is considered within the purview of this invention to configure the device to selectively illuminate portions of an indicia such as a road or to selectively illuminate other characters or indicia on receipt of appropriate command signals or according to programmed logic.

Electrical communication between power source 528, sensors 530 and electroluminescent lamp assembly 516 is accomplished by at least one suitable electrical conduit such as electrical trace 524. FIG. 12, electrical trace 524 as well as sensor 530 and power source 528 are depicted as visible for purposes of this discussion. The various control devices, electrical communication traces and power sources may be positioned in or on the substrate in a manner which does not interfere with the visual indicia. Thus the devices may be invisible to the viewer or integrated into the substrate and indicia in a harmonious manner.

The flexible sheet 10 of the present invention and all applications thereof may be prepared by various methods so as to have at least one region which is selectively illuminatable. In doing so, the first and second electrodes and at least one light transmissive material are positioned at least a position or positions on the flexible substrate 12. The first and second electrode and at least one light transmissive region are positioned so as to act cooperatively to form at least one electroluminescent lamp assembly 16. Optionally, at least one electronic trace 24 can be positioned on the substrate in a position suitable for maintaining or obtaining electrical communication with the electroluminescent lamp assembly 16.

While it is contemplated that the electroluminescent lamp assembly may be positioned in any suitable manner which will facilitate flexing and bending of the associated sheet, it is considered preferable that the electroluminescent lamp assembly 16 be built in an manner which integrates the electroluminescent lamp assembly 16 with the associated substrate and facilitates such flexing and bending.

In the preferred method, at least one of the first electrode, second electrode, and light transmissive region are positioned by deposition of discrete droplets of fluidizable material onto the substrate in contiguous contacting relationship to one another. The fluidizable material of choice is preferably a liquid which upon contact with the substrate, will solidify and adhere to the associated substrate in an essentially permanent manner. Depending on the particular element being built, the fluidizable material will have appropriate electroluminescent and/or electroconductive characteristics.

The flexible substrate 12 may be composed of any material which possesses the requisite flexing and bending capabilities and can receive and maintain suitable electroluminescent and/or non-electroluminescent indicia thereon. Non-limitative examples of such material include at least one of polymeric film, non-woven substrates and fibrous sheets such as paper. The flexible substrate 12 may be unilayered or multilayered as desired or required. Where multiple layers are employed, at least one layer is typically composed of one or more of the enumerated materials.

In depositing the fluidizable material, it is preferable that the fluidizable material be selectively ejected through a plurality of nozzles such as those found in drop ejection devices directed at the flexible substrate. The fluidizable material so deposited is believed to form a plurality of discrete units which are capable of a degree of contact suitable to maintain electronic communication therebetween. It is believed that deposition of droplets contributes to the formation of discrete regions of material with in the contiguous whole which are capable of movement relative to one another in response to movement in the associated substrate thereby creating a more flexible layer than obtainable with other deposition methods.

While it has been indicated that at least one material is prepared and deposited by drop ejection, it is to be understood that a variety of materials can be sequentially or simultaneously laid down by suitable drop ejection techniques. Thus, intricate, delicate, detailed electroluminescent lamp displays can be integrated into a substrate in the desired manner.

It is also contemplated that the drop ejector devices which depositing at least one portion of the electroluminescent lamp assembly can be coordinated with conventional printing methods and devices to integrate electroluminescent lamp assembly indicia with non-electronic indicia which may be present on or in the substrate. These include, but are not limited to, inkjet deposition methods and the like.

Devices for producing such flexible sheets by the method of the present invention would include but not be limited to at least one drop ejector having a reservoir adapted to contain a material employed in the construction of the electroluminescent lamp assembly as well as a flexible membrane or other mechanism defining an orifice through which the measured volume of the material can be emitted upon receipt of appropriate command. The device for producing the flexible sheet may also include a suitable positioning device for locating the associated drop ejector in registry with the flexible substrate and targeting the ejected droplets into position on the substrate so positioned. Thus, it is anticipated that the device may include a carriage or other suitable means for moving the drop ejector in a suitable carriage relative to a statically positioned substrate. Alternately, the substrate may be moved in registry with appropriate drop ejectors maintained in appropriate carriage devices. Such movement and ejection would be controlled by suitable control mechanisms which are capable of defining the location of at least one of the first electrode, second electrode, and light transmissive region on the substrate by the controlled ejection of droplets from the drop ejector. Suitable drop ejector mechanisms can include thermal drop ejectors, piezoelectric drop ejectors and the like as desired or required.

It is anticipated that the drop ejection method for creating such electroluminescent lamp applications can be employed in prototyping applications. Additionally it is contemplated that drop ejection methods will be particularly valuable as an enhancement for personal publishing or limited production runs; particularly due to issues such as cost efficiency and the like.

Other devices may be employed to produce the flexible sheet of the present invention, either in whole or in part. Such methods include screen printing methods in standard and roll-to-roll fashion. In such screen printing methods, it is contemplated that at least one of the traces, leads and electroluminescent lamps together with other printing can be designed on a die or drum for mass production.

It is also within the purview of the present invention that the flexible sheet of the present invention can be prepared by a combination of suitable methods as desired or required.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A book device comprising:

at least one power source;

a plurality of flexible sheets, at least one flexible sheet having:

a) a substrate having at least one exteriorly oriented visually discernable surface, the exteriorly oriented, visually discernable surface having at least one light transmissive region located thereon;

b) at least one electroluminescent lamp assembly positioned proximate to the substrate surface, the electroluminescent lamp assembly comprising at least one first electrode, electroluminescent material and at least one second electrode, wherein the electroluminescent material composes at least a portion of the at least one light transmissive region located on the substrate surface, wherein the at least one power source is in communication with the at least one electroluminescent lamp assembly;

c) a protective layer isolating the electroluminescent lamp assembly and the at least one power source from deleterious interaction with environment external to the flexible sheet; and d) at least one sensor configured to automatically detect a change in at least one environmental condition and to cause the at least one electroluminescent lamp assembly to receive power from the at least one power source in response to the automatically detected change substrate opposed-to-the-light.

2. The book device of claim 1 further comprising a controller in communication with the at least one electroluminescent lamp assembly, the controller capable of activating the at least one electroluminescent lamp assembly in a defined sequence.

3. The book device of claim 2 farther comprising an input processing device receiving data from a plurality of electroluminescent lamp assemblies located on at least two separate flexible sheets.

4. The book device of claim 3 wherein the flexible sheets are assembled in a codex.

5. The book device of claim 3 wherein the flexible sheets are composed of a flexible printable material composed of at least one of polymer film and paper.

6. The book device of claim 3 comprising an activation controlling device associated with a plurality of electroluminescent lamp assemblies, the activation controlling device including at least one logic and data storage member, the logic and data storage member governing at least one activation sequence for the plurality of electroluminescent lamp assemblies.

7. The book device of claim 6 wherein the activation controlling device is configured to selectively activate associated electroluminescent lamp assemblies according to a defined logic sequence in response to a change in at least one environmental condition detected by the at least one sensor the activation controlling device selectively illuminating associated light transmissive regions in isolation from one another pursuant to logic contained in the logic and data storage member.

8. The book device of claim 1, wherein the at least one sensor is configured to automatically detect at least one of movement, proximity, temperature change, and light level.

9. The book device of claim 1, wherein the at least one sensor comprises a light sensitive sensor.

10. The book device of claim 1, wherein the at least one sensor comprises a power conservation device configured to conserve power in the at least one power source.

* * * * *

UNITED STATES PATENT AND TRADEMARK OFFICE

CERTIFICATE OF CORRECTION

PATENT NO. : 7,396,049 B2
APPLICATION NO. : 10/971638
DATED : July 8, 2008
INVENTOR(S) : Veronica A. Nelson et al.

It is certified that error appears in the above-identified patent and that said Letters Patent is hereby corrected as shown below:

In column 6, line 47, after “by a” delete “1:0”.

In column 18, line 22, in Claim 1, after “change” delete “substrate opposed-to-the-light”.

In column 18, line 28, in Claim 3, delete “farther” and insert -- further --, therefor.

In column 18, line 48, in Claim 7, after “sensor” insert -- , --.

Signed and Sealed this

Seventh Day of July, 2009

John Doll

JOHN DOLL
*Acting Director of the United States Patent and Trademark Office*